United States Patent [19]

Adams

[11] Patent Number: 4,643,373

[45] Date of Patent: Feb. 17, 1987

[54] MISSILE SYSTEM FOR NAVAL USE

[75] Inventor: Guy E. Adams, Minnetonka, Minn.

[73] Assignee: Honeywell Inc., Minneapolis, Minn.

[21] Appl. No.: 686,047

[22] Filed: Dec. 24, 1984

[51] Int. Cl.[4] ..... F41G 7/22

[52] U.S. Cl. ..... 244/3.19; 244/3.15

[58] Field of Search ..... 244/3.19, 3.16, 3.15; 114/21 A, 20 R, 23

[56] References Cited

U.S. PATENT DOCUMENTS

| | | | |
|---|---|---|---|
| 2,879,502 | 3/1959 | Miller | 244/3.19 |
| 4,193,688 | 3/1980 | Watkins | 244/3.16 |
| 4,383,663 | 5/1983 | Nichols | 244/3.16 |

*Primary Examiner*—Charles T. Jordan

*Attorney, Agent, or Firm*—Roger W. Jensen

[57] ABSTRACT

In combination: a system operative to cause an airborne missile to track and impact a point in the wake of a marine vessel in motion; and apparatus for modifying the course of the missile in accordance with the length, velocity and wake formation time constant of the vessel.

2 Claims, 3 Drawing Figures

MISSILE SYSTEM FOR NAVAL USE

FIELD OF THE INVENTION

This invention relates to the field of armaments, and more particularly to missiles for use against naval vessels in motion.

BACKGROUND OF THE INVENTION

When a marine vessel is in motion under power, it is followed by a wake, and a particular point of the wake known as the "hot spot" is found to be radiometrically detectable more reliably than the vessel itself. When it is desired to attack such a vessel by proportional navigation of a ballistic missile launched from an aircraft or from a ground based launcher, it is known to equip the missile with an antenna system and a wake tracking computer such that the missile searches for and tracks the vessel's hot spot and impacts thereon.

The hot spot follows in the wake of the vessel at a distance behind the vessel which is related to the vessel's speed by a function which is essentially the same for practically all vessels, and which will be referred to here as the wake formation time constant. The distance in question is frequently great enough so that when a missile impacts on the hot spot, damage to the vessel itself is minimal.

SUMMARY OF THE INVENTION

The present invention contemplates a system as generally described above, but modified so that, while it tracks the hot spot as before, the missile actually impacts ahead of the hot spot, on the vessel itself.

Various advantages and features of novelty which characterize the invention are pointed out with particularity in the claims annexed hereto and forming a part hereof. However, for a better understanding of the invention, its advantages, and object attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawing, in which like reference numerals identify corresponding parts throughout the several views.

DETAILED DESCRIPTION OF THE PREFERRED EMBODIMENT

Figure 1:
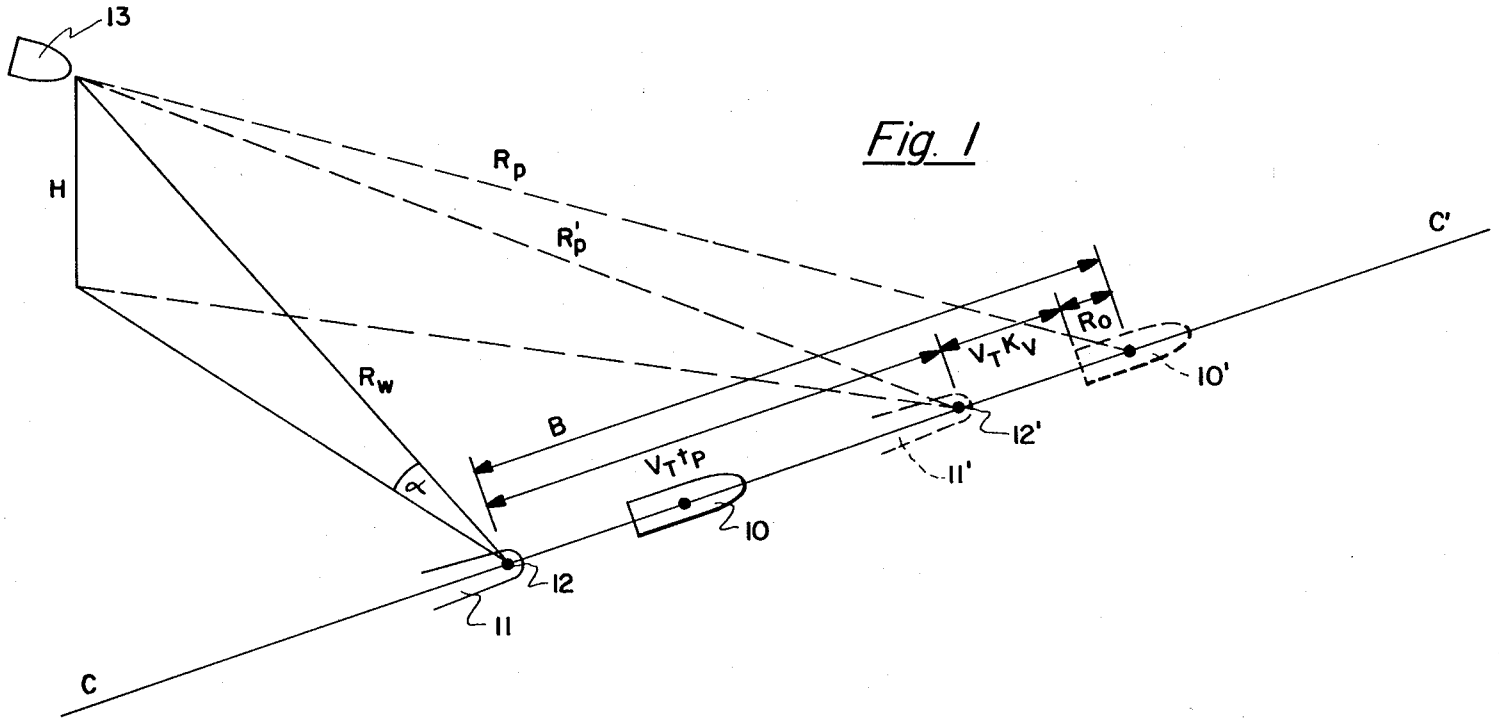
FIG. 1 is a schematic showing of the invention.

In FIG. 1, a marine vessel 10 is shown as moving along a course CC'. It produces a wake 11 characterized by a "hot spot" 12 which is radiometrically detectable. The hot spot follows the vessel at a distance which is related to the vessel's speed, and the relation appears to be essentially the same for all vessels. An airborne missile 13 contains sensing and computing equipment for determining its own speed, direction of movement, and altitude, for determining the direction of movement and speed of the hot spot, and for bringing itself onto a course which impacts the moving hot spot where it has reached a predictable point 12' in the wake 11' behind a new position of the vessel 10'. In practice the length of a target vessel and its wake formation velocity constant are known at the time the missile is launched, so that the missile can be appropriately initialized.

It has been found that impact of the missile on the hot spot behind a vessel frequently does not destroy the vessel, as would occur if the missile impacted the vessel itself. The present invention comprises means for modifying the system described so that the missile impacts the center of the vessel rather than the hot spot.

Assuming the missile is moving at a constant velocity in a proportional navigation attack (which is a straight line) on the hot spot itself, the antenna LOS will be along line $R_w$, (which will have a fixed spatial direction). The missile flight path direction will be along a somewhat different direction so as to lead the hot spot by the proper amount.

However, to impact the target at the desired future position while executing a proportional navigation attack, the missile must travel along the line labeled $R_p$.

The antenna spatial direction will be slightly different and varying to maintain its aim at the hot spot. The subject invention alters the steering signals slightly to the missile autopilot to achieve the impact at the target. This is accomplished by generating the lead angle relationships in the wake tracking computer which satisfy the guidance requirements to travel along line $R_p$ to impact at 10' such that the antenna maintains its aim toward the hot spot 12'. Without the improvement the missile would travel along $R'_p$ and impact on the hot spot at 12'. The airborne equipment for accomplishing this is shown schematically in FIG. 2.

Here a roll stabilized missile 19 is shown to have an air frame 20 with control surfaces 21 to direct its motion under the control of an autopilot 22. The airframe includes a strap-down platform 23, an air speed sensor 24, and a barometric sensor 25, which supply signals to an inertial system computer 26. The missile also includes a microwave antenna system 27 supplying signals to a wake tracking computer 28, which also receives signals from computer 26 and which supplies signals to autopilot 22, as does computer 26. The nature of the various signals and the computations performed in the computers will now be explained in detail.

Sensor 25 supplies to computer 26 a signal 30 representative of the altitude H of the missile. Sensor 24 supplies to computer 26 a signal 31 representative of the indicated air speed $V_a$ of the missile. Platform 23 supplies to computer 26 three signals 32, 33, and 34, representative of the roll rate p, pitch rate q, and yaw rate r of the airframe, and three further signals 35, 36, and 37 representative of the linear accelerations x, y, and z of the airframe along the roll, pitch, and yaw axes respectively.

Computer 26 contains a stored navigation program which primarily controls the missile heading and altitude as the mission progresses, thereby maintaining a desired flight profile. It does this by monitoring missile position and comparing this with stored navigational coordinates in the navigation program: a continuous steering vector is computed which is converted to body rate components $p_i$, $q_i$, and $r_i$ which are transmitted to computer 28 at 40, 41, and 42.

Computer 26 also extends the body rate signals at 32', 33', and 34' to autopilot 22, and supplies signals 43, 44, 45, 46, and 47 to computer 28 representative of the velocity vector $V_m$ of the missile, its altitude H, and its attitude angles $\theta$, $\phi$, and $\psi$ about roll, pitch, and yaw axes respectively. Means are also provided to supply signals 48 and 49 to computer 28 representative respectively of the half length $R_o$ of the target vessel and a quantity $k_v$ which relates the distance of the hot spot behind the vessel to the vessel's speed. If inputs 48 and 49 are set to zero, the missile impacts the hot spot itself in known fashion.

Antenna system 27 supplies to computer 28 signals 50, 51, 52, and 53 representative respectively of the azimuth angle A and elevation angle E of the antenna, its pitch rate $q_a$ and its yaw rate $r_a$. A connection 55 may be provided for controlling from computer 28 whether the antenna system is to operate in a "search" mode or a "track" mode.

Figure 3:
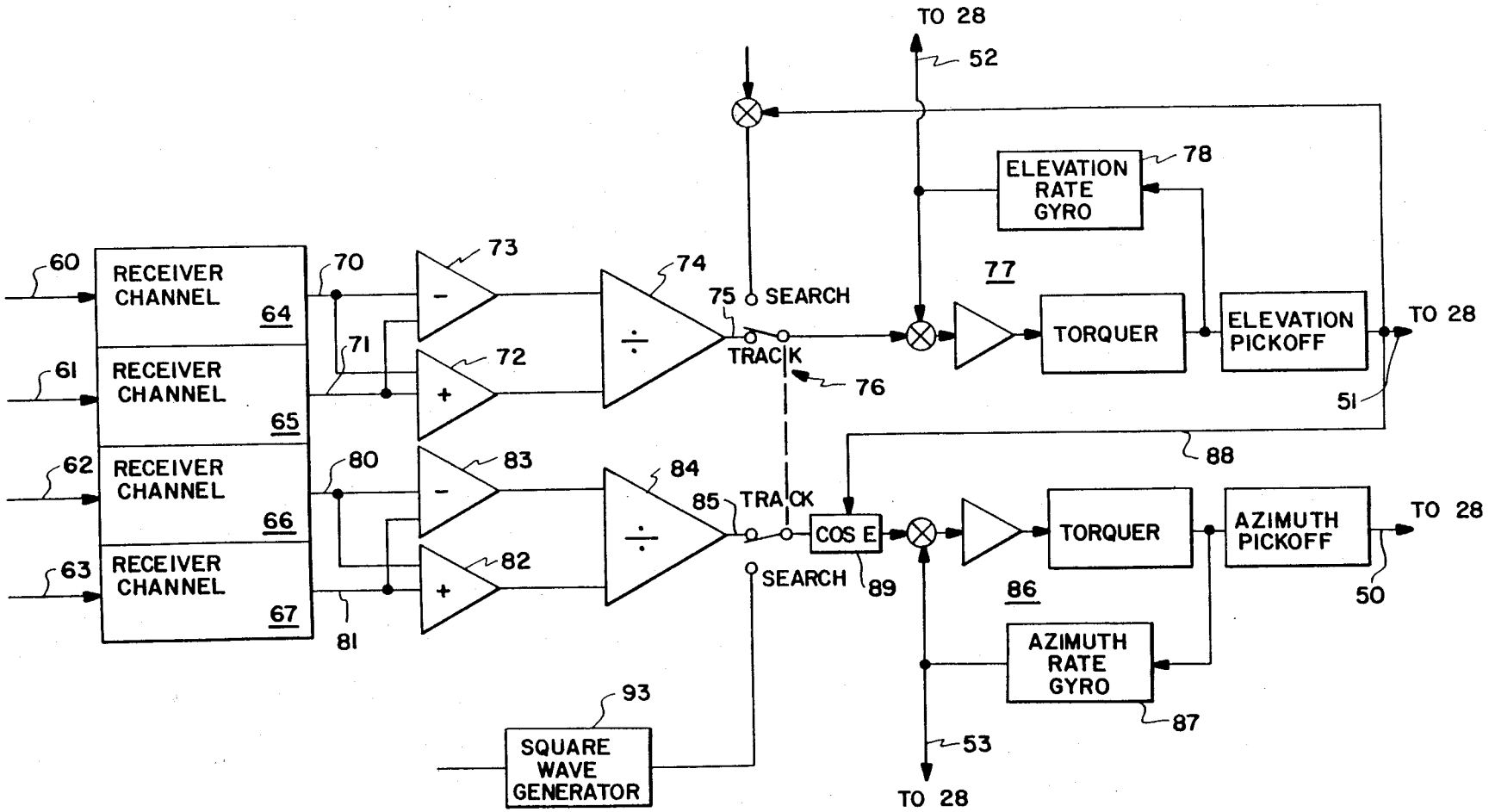
FIG. 3 is a block diagram of an antenna system useable in the apparatus of FIG. 2.

For the sake of completeness a block diagram of an antenna system suitable for use in this equipment is given in FIG. 3: such arrangements are well known. In this figure, the UP, DOWN, LEFT, and RIGHT outputs from a parabolic antenna are fed at 60, 61, 62, and 63 to receiver channels 64, 65, 66, and 67 respectively.

The outputs 70 and 71 of channels 64 and 65 are fed through a summer 72 and a differencer 73 to a divider 74 whose output 75 is the elevation error of the antenna. In the "track" condition of a switch 76 the error signal is fed to an antenna gimbal elevation torque loop 77 from which elevation signal 51 is supplied for computer 28: the loop includes a rate gyroscope 78 supplying a rate feedback in loop 77, and supplying signal 52 to computer 28.

The outputs 80 and 81 of channels 66 and 67 are fed through a summer 82 and a differencer 83 to a divider 84 whose output 85 is the azimuth error of the antenna. In the track condition of switch 76 the error is fed to an antenna gimbal azimuth torque loop 86 from which azimuth signal 50 is supplied for computer 28: the loop includes a rate gyro 87 supplying a rate feedback in loop 86, and supplying signal 53 to computer 28.

A connection 88 supplies signal 51 to a cosine device 89 in loop 86, and this figure includes incidental suggestion of components such as a square wave generator used in the "search" condition of the system.

Figure 2:
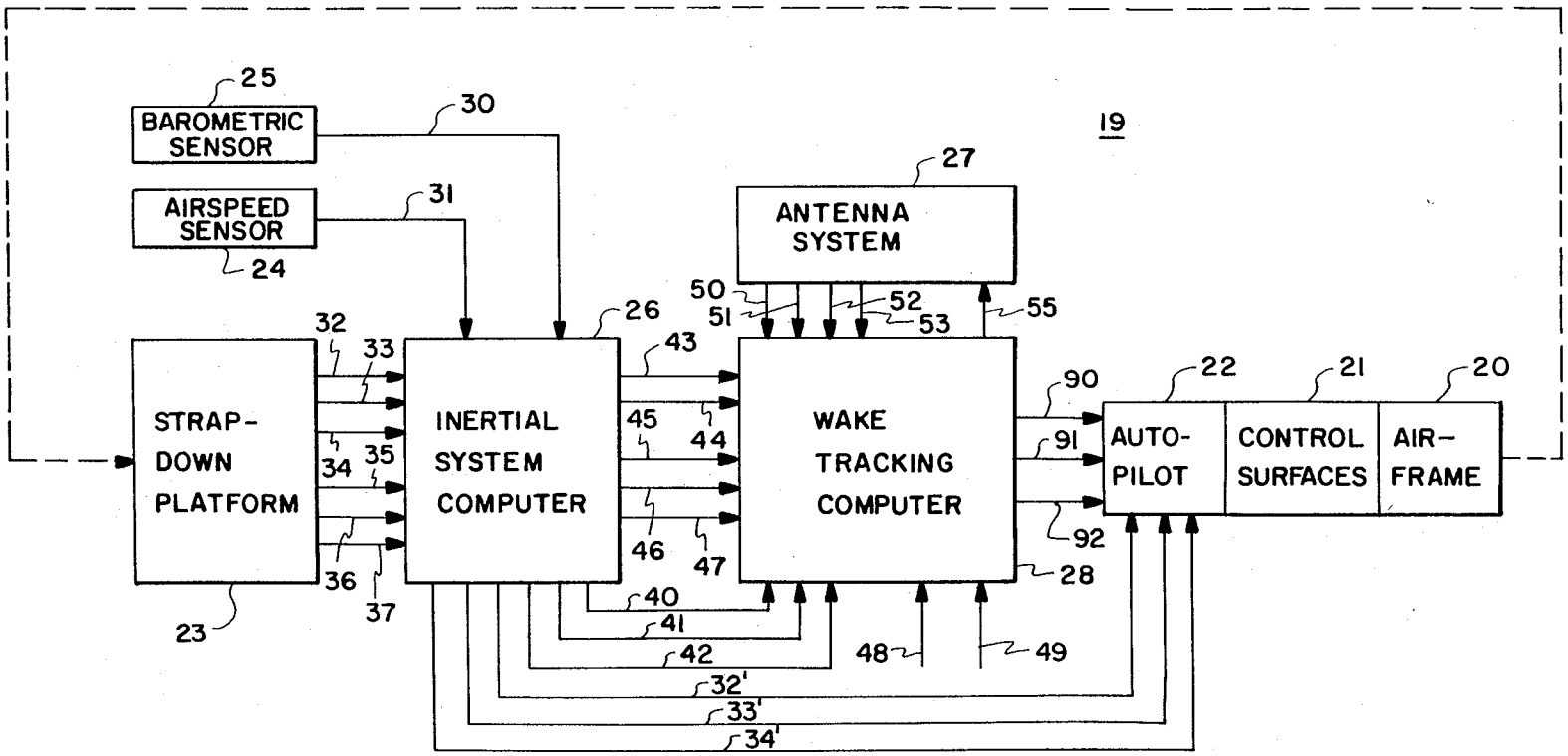
FIG. 2 is a block diagram of a system including modification to accomplish the desired result.

Computer 28 supplies signals to autopilot 22 at 90, 91, and 92, FIG. 2, resulting in actuation of the missile control surfaces in accordance with the components of a total body rate control input $\Omega$: these signals are respectively $\Omega_x$, $\Omega_y$, and $\Omega_z$ which cause roll, pitch, and yaw rotation of the missile.

OPERATION OF THE INVENTION

The repetitive computations performed in operation of the system will now be detailed, in steps which are numbered for convenience: alternative computations are, of course, possible.

For the purpose of this explanation the missile axes and flight path axes are assumed to be coincident: additional computations in the computer or the autopilot to correct for any differences between these axes are well known.

1. The angle $\gamma$ between the antenna boresight and the missile flight path axis is computed from the antenna azimuth and elevation angles as follows:

$$\gamma=\cos^{-1}(\cos E \cos A)$$

2. The slant angle $\alpha$ from the missile to the hot spot is computed from the antenna and body angles as follows:

$$\alpha=\cos^{-1}(\cos E \cos A \cos \theta+\cos E \sin A \sin \theta \sin \phi-\sin E \sin \theta \cos \phi)$$

3. The slant range $R_w$ to the hot spot is computed from the slant angle and the missile altitude as follows:

$$R_w=H/\sin \alpha$$

4. The predicted time $t_p$ to impact the hot spot is computed from the slant range, the missile velocity, and the angle between the antenna boresight and the missile flight path axis as follows:

$$t_p=R_w/V_m \cos \gamma$$

5. The line of sight rate $\Omega_a$ is computed from the two antenna rate gyro outputs, as follows:

$$\Omega_a=(q_a^2+r_a^2)^{\frac{1}{2}}$$

6. The component $V_n$ of the target velocity normal to the line of sight is computed from the flight path velocity, the angle between the line of sight and the flight path, the line of sight rate, and the slant range as follows:

$$V_n=V_m \sin \gamma-\Omega_a R_w$$

7. The antenna boresight rotation $\phi$ is computed from the antenna elevation rate and the line of sight rate as follows:

$$\phi=\sin^{-1}(r_a/\Omega_a)$$

8. The angle $\kappa$ between the line of sight to the hot spot and the target velocity vector is computed from missile attitude angles and the antenna boresight rotation by solving the following two transcendental equations iteratively $$\cos \kappa=\cos \alpha \cos A$$

$$\cos \kappa \cos \alpha \cos A-\sin \kappa \sin \sin A-\sin \kappa \cos \phi \sin \alpha \cos A=1$$

9. The component $V_p$ of hot spot velocity parallel to the line of sight is computed from the normal velocity component and the angle $\kappa$ as follows:

$$V_p=V_n \cot \kappa$$

10. The target velocity magnitude $V_t$ is computed from the normal and parallel components of the target velocity as follows:

$$V_t=(V_n^2+V_p^2)^{178}$$

11. The "lead distance" from the hot spot to the desired impact point at the center of the vessel is computed as follows from the target velocity, predicted time to impact, half length of the vessel $R_0$, and an arbitrary quantity $k_v$ relating the distance of the spot behind the vessel to the vessel speed; for most cases this is a constant. This step is the heart of the inventive contribution here.

$$B=R_0+V_t(k_v+t_p)$$

12. The predicted range magnitude $R_p$ to the impact point on the vessel is computed from the target slant range, the lead distance, and the angle between the line of sight to the hot spot and the target velocity vector as follows:

$$R_p=((R_w+B\cos\kappa)^2+(B\sin\kappa)^2)^{\frac{1}{2}}$$

13. The prediction angle $\theta_p$ (between the line of sight to the hot spot and the range vector to the desired impact point) is computed from the lead distance, predicted range magnitude, and angle between the line of sight to the hot spot and the target velocity vector as follows:

$$\theta_p=\sin^{-1}(B\sin\kappa/R_p)$$

14. The flight path direction error $\kappa$ is essentially a vector computed from the prediction angle and the missile flight path angle as follows:

$$\epsilon=\theta_p-\gamma$$

15. The magnitude of the total missile rate correction error $\Omega$ is a vector control input which is computed from the direction error and a system control constant, $\epsilon$ as follows:

$$\Omega=k_u\epsilon$$

16. The components of the control input are computed as follows, by resolving the control input along body axes.

$$\Omega_x=\Omega(-\cos\Omega\sin A+\sin\Omega\sin E\cos A)$$

$$\Omega_y=\Omega(\cos\Omega\cos A+\sin\Omega\sin E\sin A)$$

$$\Omega_z=\Omega(\sin\Omega\cos E)$$

These quantities are supplied to autopilot 22 as signals 90, 91, and 92. The autopilot compares these signals with signals 32', 33', and 34' and actuates the missile control surfaces accordingly.

From the foregoing it will be evident that I have invented an arrangement including a wave tracking computer which is compensated for the distance between a vessel and the following hot spot in the vessel's wake, so that a missile radiometrically tracking the hot spot proceeds to impact on the vessel itself.

The embodiments of the invention in which an exclusive property or right is claimed are defined as follows:

1. In a missile having control surfaces and an autopilot for actuating said surfaces in accordance with control signals, in combination:

a strap-down platform giving outputs in accordance with the angular rates of the missile about mutually orthogonal axes and with the linear accelerations of said missile along said axes;

sensing means giving outputs in accordance with the altitude and air speed of the missile;

an inertial system computer including a stored navigation program, and deriving from all said outputs further outputs representative of the attitude angles of the missile, of its velocity vector, and of body rate commands representative of deviations of said platform outputs from values in said program;

an antenna system including a directional antenna fixed in said missile and means giving further outputs representative of the elevation and azimuth angles of departure of said antenna from a moving radiometric target and of the rates of change of said angles;

a tracking computer receiving all said further outputs and deriving therefrom control signals for said autopilot, to cause said missile to impact said target;

and means initializing said tracking computer to modify its operation so as to cause said missile to impact a point moving with said target at a known location with respect thereto.

2. In a missile having control surfaces and an autopilot for actuating said surfaces in accordance with control signals, in combination:

a strap-down platform giving outputs in accordance with the angular rates of the missile about mutually orthogonal axes and with the linear accelerations of said missile along said axes;

sensing means giving outputs in accordance with the altitude and air speed of the missile;

an inertial system computer including a stored navigation program, and deriving from all said outputs further outputs representative of the attitude angles of the missile, of its velocity vector, and of body rate commands representative of deviations of said platform outputs from values in said program;

an antenna system including a directional antenna fixed in said missile and means giving further outputs representative of the elevation and azimuth angles of departure of said antenna from a moving radiometric target comprising the hot spot in the wake of a moving marine vessel, and of the rates of change of said angles;

a wake tracking computer receiving all said further outputs, computing the velocity of said target, and deriving control signals for said autopilot to cause said missile to impact said target;

and means initializing said wake tracking computer in accordance with known characteristics of the vessel and its computed velocity so as to cause to missile to impact the vessel rather than the hot spot.

* * * * *